United States Patent [19]

Gurwicz et al.

[11] 3,963,967

[45] June 15, 1976

[54] CONTACTOR INTERLOCK CIRCUITS

[75] Inventors: David Gurwicz; Albert Everett Sloan, both of Gateshead, England

[73] Assignee: Sevcon Engineering Limited, Gateshead, England

[22] Filed: Nov. 21, 1974

[21] Appl. No.: 526,060

[30] Foreign Application Priority Data

Nov. 23, 1973 United Kingdom ..... 54475/73

[52] U.S. Cl. ..... 317/123; 317/DIG. 6

[51] Int. Cl.[2] ..... H01H 47/00

[58] Field of Search ..... 317/DIG. 5, DIG. 6, 317/123; 318/139; 340/248 R

[56] References Cited

UNITED STATES PATENTS

| | | | |
|---|---|---|---|
| 2,769,131 | 10/1956 | Immel | 317/DIG. 6 |
| 3,275,899 | 9/1966 | De Wolf | 317/DIG. 6 |
| 3,764,870 | 10/1973 | Morton et al. | 318/139 |

*Primary Examiner*—R. N. Envall, Jr.

*Assistant Examiner*—Harry Moose

*Attorney, Agent, or Firm*—Alfred H. Rosen; Frank A. Steinhilper

[57] ABSTRACT

A thyristor pulse controller having an electromagnetically actuated shorting contactor comprising an actuating coil and an armature which moves on energization of the actuating coil to close the contactor tips and which moves on de-energization of the coil to open the contactor tips and to create an air-gap in the magnetic circuit of the coil, is provided with an interlock circuit comprising a voltage sensing circuit connected in parallel with the contactor actuating coil, the voltage sensing circuit being adapted to provide an output signal when the modulus of the voltage across the actuating coil exceeds a predetermined value which is lower than the modulus of the voltage across the coil at the instant when the contactor tips open. A unidirectional current path, which may be provided by the interlock circuit itself, is connected across the actuating coil to dissipate inductive energy in the coil when the contactor opens.

9 Claims, 4 Drawing Figures

CONTACTOR INTERLOCK CIRCUITS

Figure 1:
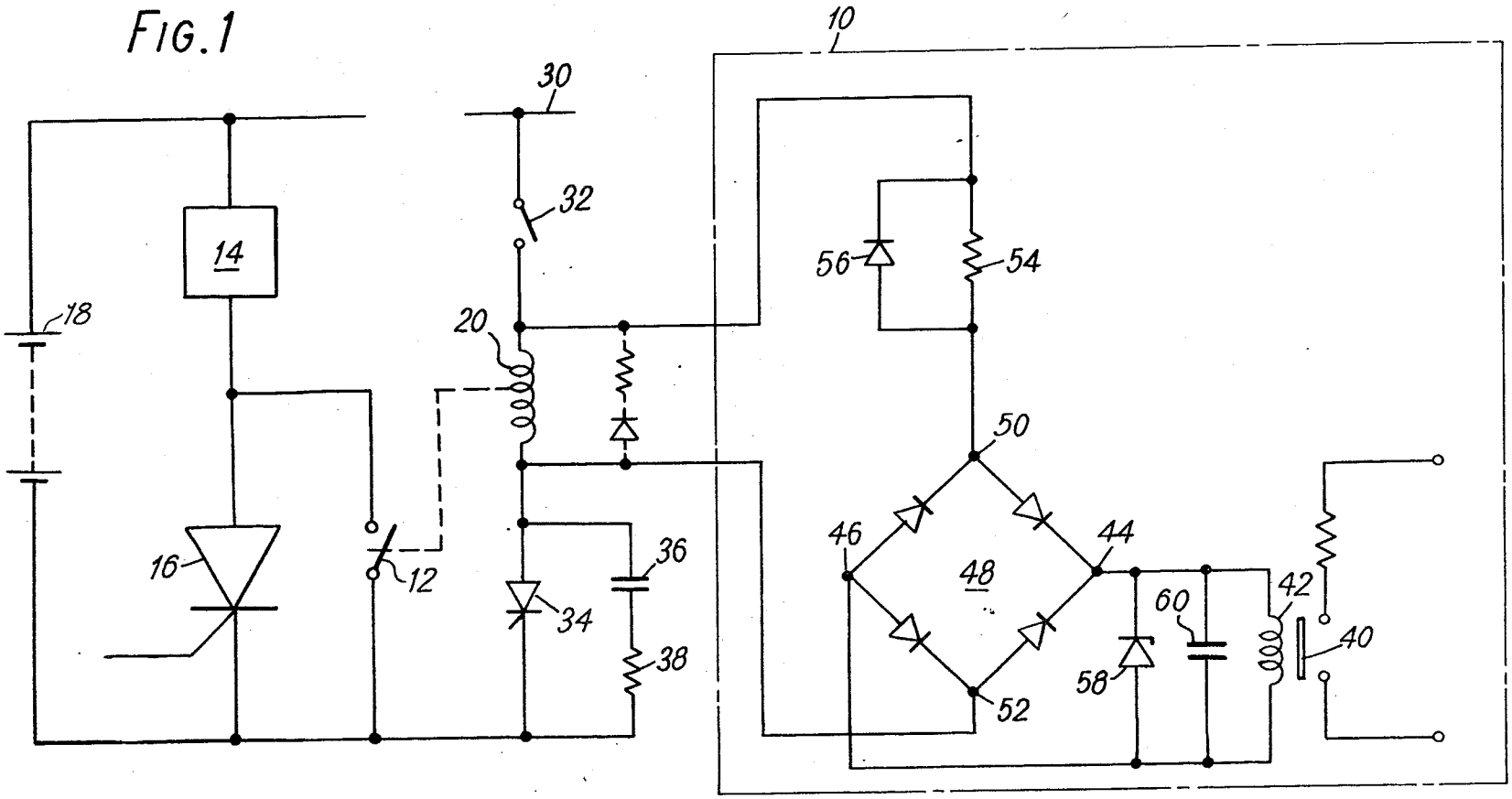

This invention relates to contactor interlock circuits.

When an electromagnetically actuated contactor is used to control current in a d.c. circuit, it is often necessary to provide control signals to other parts of the circuit to indicate when the contactor is closed. It is often desirable that the signal indicating closure of the contactor should be provided a short time before the contactor tips move into contact, and the signal indicating opening of the contactor (which may be the cessation of the control signal which indicates closure of the contactor) should be provided a short time after the contactor tips have moved apart.

For example, in thyristor pulse control circuits employed to control the supply of power from a d.c. source to a load, such as a d.c. motor, through a main thyristor which is rendered alternately conducting and non-conducting, there is usually provided in parallel with the main thyristor a contactor (the so-called "shorting contactor") closure of which connects the load directly to the source. It is often necessary to provide signals to other parts of the pulse control circuit to indicate when the shorting contactor is closed. For example, control signals may be employed to inhibit operation of the oscillators controlling the firing and commutation of the main thyristor whilst the shorting contactor is closed, and to ensure that a path is provided for charging the commutating capacitor forming part of the commutating circuit for the main thyristor, so that the capacitor has sufficient charge to enable the pulse control circuit to resume operation when the shorting contactor opens. When the pulse control circuit is provided with a fail-safe protective circuit which operates to disconnect the pulse control circuit from the d.c. source in the event that the main thyristor remains conducting for a time longer than a predetermined time, a control signal may be employed to inhibit operation of the fail-safe circuit when the shorting contactor is closed. In such a case it is necessary that the inhibition of the fail-safe circuit should not be removed until the contactor tips have opened.

Hitherto, such control signals have been obtained by means of a normally-open microswitch connected to the contactor tips, so that the microswitch is closed whenever the contactor is closed. This however raises problems owing to the need for accurate adjustment of the microswitch so that it closes before the contactor tips close and opens after the contactor tips have opened, and the danger of the microswitch going out of adjustment during use of the circuit.

When the voltage applied to the actuating coil of a contactor is removed, to de-energise the coil and cause movement of its armature to open the contactor tips, an inductive voltage appears across the coil, in a direction opposed to that of the originally applied voltage. If a voltage transient supression circuit in the form of a unidirectional current path is connected across the coil to enable the current in the coil to circulate, the inductive energy in the coil being dissipated by resistance in the circulation path, the current flowing through the coil and the voltage across it begin to fall exponentially. When the current in the actuating coil reaches a value at which it is insufficient to hold the contactor tips together, the armature moves so that the tips begin to move apart. Movement of the armature creates an air-gap in the magnetic circuit of the actuating coil. A rapid decrease in the magnetic flux in the circuit therefore occurs, causing the magnitude of the voltage across the coil to increase, after which the voltage begins again to fall exponentially towards zero. The magnitude of the voltage across the actuating coil of the contactor therefore remains at an appreciable level for a period after the tips have parted.

This invention includes a contactor interlock circuit for use with an electromagnetically actuated contactor having an actuating coil which is connected through switch means to a d.c. source and has an armature which moves on energisation of the actuating coil to close the contactor tips and which on de-energisation of the actuating coil moves to open the contactor tips and to create an air-gap in the magnetic circuit of the coil, the interlock circuit comprising a voltage sensing circuit adapted to be connected in parallel with the actuating coil of the contactor in such a manner as to provide a unidirectional current path through which inductive energy in the coil is dissipated when the switch means is operated to disconnect the coil from the d.c. source, the voltage sensing circuit being adapted to provide an output signal when the modulus of the voltage across the actuating coil exceeds a predetermined value which is lower than the modulus of the voltage appearing across the coil at the instant when the contactor tips open.

The invention also includes a thyristor pulse controller including thyristor means adapted to be connected in series with a load and a d.c. source and an electromagnetically actuated shorting contactor connected in parallel with the thyristor means, the shorting contactor comprising an actuating coil and an armature which moves on energisation of the actuating coil to close the contactor tips and which move on de-energisation of the coil to open the contactor tips and to create an air-gap in the magnetic circuit of the coil, a voltage transient supression circuit comprising a unidirectional current path across the actuating coil through which in use inductive energy in the coil is dissipated when current supply to the coil is disconnected, and an interlock circuit comprising a voltage sensing circuit connected in parallel with the contactor actuating coil, the voltage sensing circuit being adapted to provide an output signal when the modulus of the voltage across the actuating coil exceeds a predetermined value which is lower than the modulus of the voltage across the coil at the instant when the contactor tips open.

Suitably the unidirectional current path is provided by the interlock circuit.

The voltage sensing circuit may comprise a relay, having a response time shorter than that of the contactor, connected in series with rectifying means across the actuating coil. Alternatively, the voltage sensing means may comprise a semiconductor voltage-responsive circuit.

Figure 2:
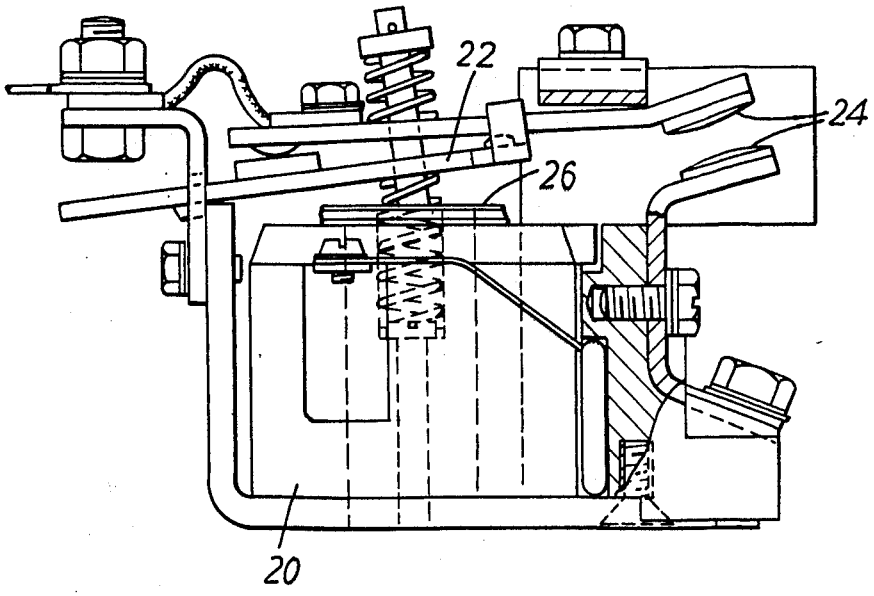
Figure 3:
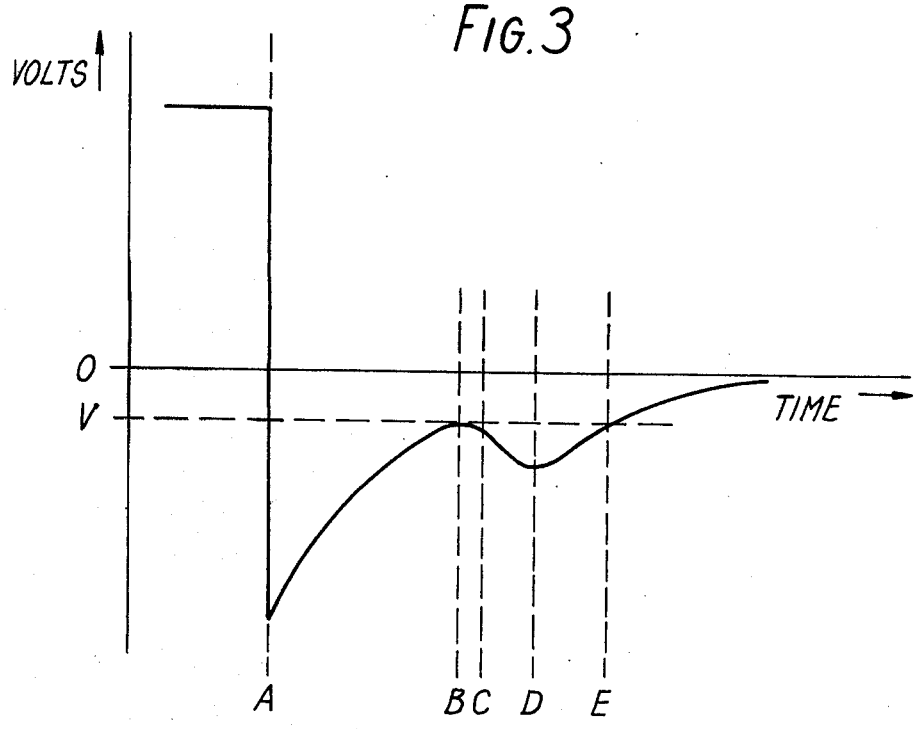
Figure 4:
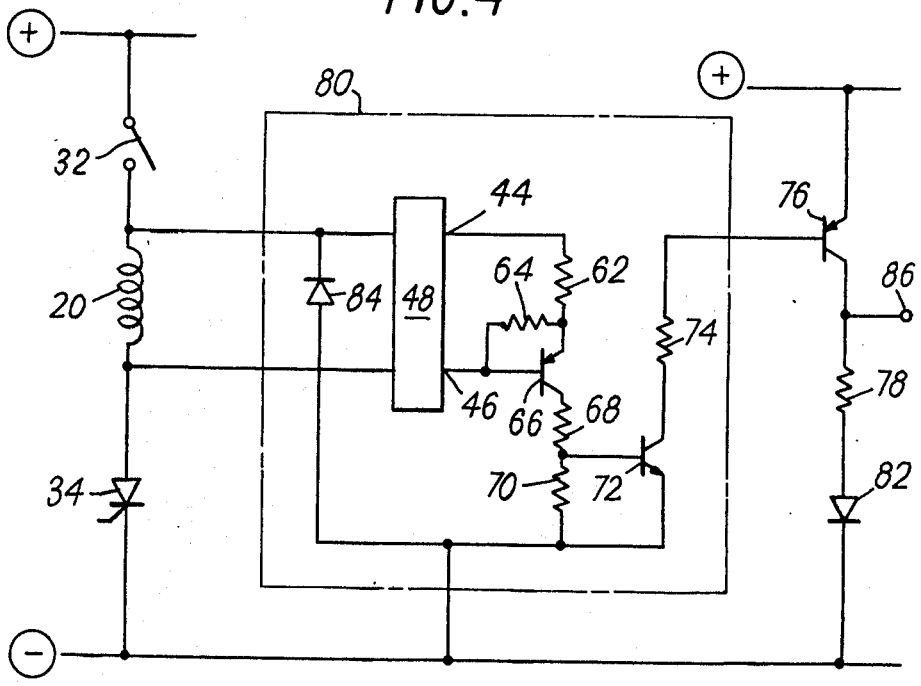

The invention will now be described, by way of example, with reference to the accompanying drawings, in which:

FIG. 1 is a diagram of a contactor interlock circuit in accordance with the invention, connected to the shorting contactor of a thyristor pulse controller, FIG. 2 is a diagrammatic representation of the principal components of the shorting contactor of FIG. 1, FIG. 3 is a graph showing the variation with time of the voltage across the actuating coil of the shorting contactor when the voltage applied to the coil is removed, and FIG. 4 is a diagram of a modified form of contactor interlock circuit according to the invention.

Referring to FIG. 1, there is shown an interlock circuit 10 for use with the shorting contactor 12 of a thyristor pulse controller for controlling the power supplied to a d.c. traction motor 14 of a battery-electric vehicle, the pulse controller including a main thyristor 16 connected in series with the motor 14 and a d.c. source 18. Suitable control circuits, such as are well known in the art, are provided for alternately firing and commutating thyristor 16 so that pulses of current are supplied from source 18 to the motor 14 and for varying the mark-space ratio of the pulses to vary the mean voltage applied to the motor. The shorting contactor 12 is connected across the main thyristor 16 of the pulse controller so that closure of the contactor 12 connects the motor 14 direct to the d.c. source 18. The shorting contactor 12 is actuated by means of an actuating coil 20, having an armature 22 (FIG. 2) which moves, on energisation of the coil 20, to close the contactor tips 24 and, on de-energisation of the coil 20, to open the contactor tips. Movement of the armature 22 away from a stop 26 during the latter movement creates an air gap in the magnetic circuit of the actuating coil 20, the air-gap appearing an instant before the contactor tips 24 open. One side of the actuating coil 20 is connected to a stabilised low-voltage rail 30 through a switch 32, which is connected to the accelerator pedal of the vehicle so as to be closed when the pedal is fully depressed. The other side of the coil 20 is connected through a thyristor 34 to the negative side of the supply. Thyristor 34 is arranged to be fired into conduction by a gating pulse from a delay circuit (not shown) forming part of the control circuits of the pulse controller which acts to delay energisation of coil 20 and closing of shorting contactor 12 if the accelerator pedal is suddenly fully depressed. Such a delay circuit is described in British patent specification No. 963,648. Connected in series across thyristor 34 are a capacitor 36 and resistor 38 which provide a latching circuit for thyristor 34, the capacitor being initially charged through coil 20 and resistor 38 when switch 32 is closed and subsequently discharging through thyristor 34 when it is fired into conduction. The discharge current through thyristor 34 is sufficient to maintain it in conduction until the current flow through coil 20 has built up to a value above the holding current of the thyristor. The thyristor can therefore be fired with a sharp gating pulse. The thyristor 34 is automatically commutated when switch 32 is opened to disconnect coil 20 from the supply.

The interlock circuit 10 consists of a normally-open relay 40, the actuating coil 42 of which is connected across the output terminals 44 and 46 of a full-wave rectifier 48, in the form of a bridge circuit of four diodes. The input terminals 50 and 52 of the full-wave rectifier 48 are connected in series with a resistor 54 across the actuating coil 20 of the shorting contactor 12. A further diode 56 is connected in parallel with the resistor 54, in a direction opposed to the voltage across the shorting contactor actuating coil 20 when that coil is energised. A zener diode 58 is connected in parallel with the actuating coil 42 of the relay 40 to limit the voltage which can be applied to the coil 42 through the full-wave rectifier 48. A capacitor 60 is also connected in parallel with coil 42.

In operation, when the switch 32 is closed and the thyristor 34 in series with it is rendered conducting a voltage is applied across the actuating coil 20 of the shorting contactor 12 and also across the interlock circuit 10. Current flows through the resistor 54 and the full-wave rectifier 48 to the actuating coil 42 of the relay 40, so that the contacts of the relay 40 close. The characteristics of the relay 40 are chosen so that it has a response time shorter than that of the shorting contactor 12, to ensure that the relay contacts close before the shorting contactor tips 24 have closed.

When the accelerator pedal is released so that switch 32 is opened to disconnect the actuating coil 20 of the shorting contactor 12 from the supply voltage, an inductive voltage appears across the actuating coil owing to the current flow through it, the voltage being in a direction opposite to that of the supply voltage, as shown at A in FIG. 3. The inductive voltage produces a current flow through the full-wave rectifier 48, the relay actuating coil 42 and the diode 56 across the resistor 54 in the interlock circuit. The path through which the current circulates includes the inherent resistance of the actuating coils 20 and 42 of the shorting contactor 12 and relay 40, so that the inductive energy in the shorting contactor actuating coil 20 is gradually dissipated, the current and the voltage across the coil beginning to fall exponentially (as shown between points A and B in FIG. 3). When the current in the shorting contactor actuating coil 20 reaches a value at which it is insufficient to hold the contactor tips 24 together, the armature 22 begins to move to move the tips 24 apart. An air gap is thus created in the magnetic circuit of the actuating coil 20 as described above. A rapid decrease in the magnetic flux in the circuit therefore occurs, causing the modulus of the voltage across the coil 20 to increase (as shown between points B and D in FIG. 3), after which the modulus of the voltage begins again to fall exponentially towards zero, as shown in FIG. 3. The region of the graph between points B and C in FIG. 3 represents the time during which the contactor tips are opening. The magnitude of the voltage across the actuating coil of the shorting contactor therefore remains at an appreciable level for a period after the contactor tips 24 have parted. The characteristics of the relay 40 are chosen so that the relay contacts remain closed whenever the modulus of the voltage applied to the interlock circuit 10 exceeds the modulus of the voltage V across the actuating coil 20 of the shorting contactor 12 at the instant that the contactor tips 24 move apart. The relay contacts therefore do not open until the voltage across the shorting contactor actuating coil 20, having risen as described above after the contactor tips 24 open, falls again to a voltage below the above-mentioned voltage (at point E in FIG. 3), at an appreciable time after the shorting contactor tips 24 have opened.

The provision of the full-wave rectifier 48 in the interlock circuit 10 ensures that the voltage applied to the relay coil 42 is always in the same direction, so that there is no danger of the relay contacts opening as the voltage across the shorting contactor actuating coil 20 is reversed when the switch 32 is opened. The presence of the resistor 54 in the interlock circuit 10 reduces the voltage applied to the relay actuating coil 42 when the relatively high voltage across the energised shorting contactor actuating coil 20 is applied to the interlock circuit 10, whilst the diode 56 across resistor 54 allows the full magnitude of the lower reversed voltage across the shorting contactor actuating coil 20 to be applied to the relay coil 42.

The capacitor 60 connected across the actuating coil 42 of relay 40 acts to prevent voltage transients appearing across the shorting contactor actuating coil 20 from causing actuation of the relay 40. Such transients appear when switch 32 is closed before thyristor 34 is gated, owing to the oscillatory circuit formed by the source 18, switch 32, coil 20, capacitor 36 and resistor 38.

FIG. 4 shows a modified form of interlock circuit, in which an electronic voltage sensing circuit 80 is used instead of relay 40. The voltage sensing circuit comprises a full-wave rectifier 48, as in the embodiment of FIG. 1, the output of which is connected across a voltage divider consisting of resistors 62 and 64 in series. The negative terminal 46 of rectifier 48 is connected to the base of a p-n-p transistor 66, the emitter of which is connected to the junction of resistors 62 and 64, and the collector of which is connected through series-connected resistors 68 and 70 to the negative line of the supply. The junction of resistors 68 and 70 is connected to the base of an n-p-n transistor 72, the emitter of which is connected to the negative supply line. The collector of transistor 72 is connected through a resistor 74 to the base of p-n-p transistor 76, the emitter of which is connected to the positive line of the supply and the collector of which is connected through a resistor 78 and diode 82 to the negative supply line. A diode 84 is connected between the negative supply line and the junction of coil 20 and switch 32 to provide a circuit for dissipating the energy in coil 20 when switch 32 is opened. The values of the components of the voltage sensing circuit are chosen so that transistors 66 and 72 are rendered conducting when the voltage output of the rectifier 48 exceed the predetermined value V. When transistor 72 conducts, the potential at the base of transistor 76 is pulled down to render transistor 76 conducting, so that current flows through resistor 78 and a signal appears at the output terminal 86 of the interlock circuit.

In the embodiments described, the interlock circuit itself provides a unidirectional current path across the contactor actuating coil 20 to allow circulation of the current flowing through coil 20 when the voltage applied to the coil is removed, and thereby to allow the inductive energy to be dissipated without the danger of high transient voltages appearing across the coil. It will be appreciated, however, that the invention could also be applied to a contactor already provided with a voltage transient suppression circuit in the form of a resistive unidirectional current path (e.g. a diode and resistor in series as shown in broken lines in FIG. 1) across its actuating coil, in which case it would not be essential for the interlock circuit itself to provide such a current path.

It will be appreciated that the predetermined voltage at which the voltage sensing circuit provides the output signal may be set at any suitable level below the modulus of the voltage across the shorting contactor actuating coil at the instant when the contactor tips open, the actual level being chosen in practice so that the output signal is given at a suitable time after the contactor tips have opened.

We claim:

1. A contactor interlock circuit for use with an electromagnetically actuated contactor having an actuating coil which is connectible through switch means to a d.c. source and has an armature which moves on energisation of the actuating coil to close the contactor tips and which on de-energisation of the actuating coil moves to open the contactor tips and to create an air-gap in the magnetic circuit of the coil, the interlock circuit comprisng a voltage sensing circuit connected in parallel with the actuating coil of the contactor in such a manner as to provide a unidirectional current path through which inductive energy in the coil is dissipated when the switch means is operated to disconnect the coil from the d.c. source, the voltage sensing circuit sensing the voltage across the actuating coil and providing an output signal when the modulus of said voltage exceeds a predetermined value which is lower than the modulus of said voltage appearing across the coil at the instant when the contactor tips open after opening of the switch means.

2. A circuit as claimed in claim 1, in which the voltage sensing circuit comprises a relay having a response time less than that of the shorting contactor.

3. A circuit as claimed in claim 2, in which the relay includes a relay actuating coil connected across the output of a full-wave rectifier, the input of which is in use connected across the shorting contactor actuating coil, the relay actuating coil and the rectifier providing the said unidirectional current path.

4. A circuit as claimed in claim 3, in which the input terminals of the rectifier are connected in series with resistor means to reduce, in use, the voltage applied to the rectifier when the said switch means is closed, and a diode is connected across the resistor means in such a direction as to be conductive when the voltage across the shorting contactor actuating coil reverses on opening of the switch means to disconnect the coil from the d.c. source.

5. A circuit as claimed in claim 1, in which the voltage sensing circuit comprises transistor switch means connected in use across the shorting contactor actuating coil and operable to provide an output signal when the modulus of the voltage across the coil exceeds said predetermined value.

6. A thyristor pulse controller including thyristor means intended to be connected in series with a load and a d.c. source and an electromagnetically actuated shorting contactor connected in parallel with the thyristor means, the shorting contactor comprising an actuating coil and an armature which moves on energisation of the actuating coil to close the contactor tips and which moves on de-energisation of the coil to open the contactor tips and to create an air-gap in the magnetic circuit of the coil, a voltage transient suppression circuit comprising a unidirectional current path across the actuating coil through which in use inductive energy in the coil is dissipated when current supply to the coil is disconnected, and an interlock circuit comprising a voltage sensing circuit connected in parallel with the contactor actuating coil, the voltage sensing circuit sensing the voltage across the actuating coil and providing an output signal when the modulus of said voltage exceeds a predetermined value which is lower than the modulus of said voltage across the coil at the instant when the contactor tips open after opening of the switch means.

7. A pulse controller as claimed in claim 6, in which the unidirectional current path is provided by the interlock circuit.

8. A pulse controller as claimed in claim 6, in which the unidirectional current path comprises a diode and resistor in series across the shorting contactor actuating coil.

9. A pulse controller as claimed in claim 6, and adapted to control the mean voltage applied to a d.c. motor forming the traction motor of a vehicle, in which there is provided a switch coupled to the accelerator pedal of the vehicle and operable selectively to connect the shorting contactor actuating coil to, and disconnect the coil from, the d.c. source.

* * * * *